US007905020B2

(12) United States Patent
Rozenkranc

(10) Patent No.: US 7,905,020 B2
(45) Date of Patent: Mar. 15, 2011

(54) AUTOMATIC SHAVING APPARATUS SYSTEM

(76) Inventor: Menachem Rozenkranc, Tel Aviv (IL)

( * ) Notice: Subject to any disclaimer, the term of this patent is extended or adjusted under 35 U.S.C. 154(b) by 674 days.

(21) Appl. No.: 11/212,659

(22) Filed: Aug. 29, 2005

(65) Prior Publication Data

US 2007/0044313 A1 Mar. 1, 2007

(51) Int. Cl.
*B26B 19/28* (2006.01)

(52) U.S. Cl. ..... 30/42; 30/32

(58) Field of Classification Search ..... 30/32, 41, 30/42, 44, 45; 222/52, 638; 401/263, 264
See application file for complete search history.

(56) References Cited

U.S. PATENT DOCUMENTS

| | | | | |
|---|---|---|---|---|
| 3,925,888 | A * | 12/1975 | Bozsanyi | 30/29.5 |
| 4,341,230 | A * | 7/1982 | Siahou | 434/263 |
| 5,299,354 | A | 4/1994 | Metcalf et al. | |
| 6,276,061 | B1 | 8/2001 | Rozenkranc et al. | |
| 6,415,517 | B1 | 7/2002 | Worrick, III | |
| 6,460,251 | B1 * | 10/2002 | Orloff | 30/41.7 |
| 6,836,965 | B1 | 1/2005 | Ross | |
| 6,836,966 | B2 | 1/2005 | Patrick | |
| 2006/0032061 | A1 | 2/2006 | Rozenkranc | |
| 2006/0123631 | A1 * | 6/2006 | Szczepanowski et al. | 30/44 |

FOREIGN PATENT DOCUMENTS

| | | | |
|---|---|---|---|
| GB | 2398533 | * | 8/2004 |
| WO | WO-2004/073940 | A1 | 9/2004 |
| WO | WO-2004/073941 | A1 | 9/2004 |

* cited by examiner

*Primary Examiner* — Phong H Nguyen
(74) *Attorney, Agent, or Firm* — Birch, Stewart, Kolasch & Birch, LLP

(57) ABSTRACT

A shaving apparatus system includes an electrically actuated and starting and shutting off device for improved shaving comfort. The system can include an electrical device, e.g. a battery, which actuates an operating device, e.g. vibrating, oscillating, heating and water-sprinkling system, etc.

18 Claims, 3 Drawing Sheets

AUTOMATIC SHAVING APPARATUS SYSTEM

BACKGROUND OF THE INVENTION

1. Field of the Invention

The present invention relates to a shaving apparatus system, which comprises an electrically actuated and starting and shutting off system for improved shaving comfort. Said system comprises electrical means, e.g. a battery, which actuates operating means, e.g. vibrating, oscillating, heating and water-sprinkling means, etc.

2. Description of Background Art

There are known many systems which comprise actuating operating means, e.g. those indicated in U.S. Pat. Nos. 5,299,354 (Gillette) and 6,836,966 (SLE Limited Partnership). However, it has to be stressed that all said known systems are not automatic. This is not convenient as the activation of such operating means which are not automatic is quite inconvenient and an inadvertent shutoff may occur from time to time and therefore one had to look for an automatic system.

SUMMARY OF THE INVENTION

The present invention thus consists in a shaving apparatus system which comprises automatic actuating means for starting and shutting off of the shaving action.

The actuating means may consist of electrical means, e.g. a battery and means which cause the operation of vibrating, oscillating heating and/or water-sprinkling means, etc.

As automatic means may be used for example triggering means for detection of start, continuation and stop of the shaving action for the actuating means.

Numerous means to trigger the automatic means for the starting of the shaving apparatus are known. Such means may be for example touch sensor, motion sensor etc. The preferred means being a simple self actuated momentary switch. However, the present invention is not restricted to such triggering means but may comprise also other automatic actuating means.

Said momentary switch may be integrated in the blades unit holder. The triggering function will start automatically with the first shaving stroke and stop with a short delay after the last stroke (after about three seconds).

The preferred embodiment of the present invention consists thus in an automatic starting and shutting off system for a shaving apparatus incorporating a battery operating vibrating, oscillating, heating and/or water-sprinkling system comprising for the starting of the shaving apparatus triggering means, preferably a momentary switch.

Said switch comprises, for example, short and long electrical contact bars embedded in a blades unit holder body and an electrical bridge that slides along said bars closing or opening the electrical circuit dependent on bridge location. The bars are advantageously electrically connected to the triggering wires.

Said switch is advantageously integrated in the blades unit holder and is self activated by the pivoting action of the blades unit and the corresponding movement of the spring loaded tab that normally maintains the blades pressure against the skin.

Said momentary switch works, for example, as follows: When no pressure is applied to the blades unit, the shaving apparatus is in rest position and the spring loaded tab extends outwards. One end of an electrical bridge, being part of the spring loaded tab, rests against the long electrical contact bar embedded in the blades unit holder. The other end of said bridge is not in touch with the short electrical contact bar thus it opens a triggering circuit. With the first shaving stroke and with every following shaving stroke the spring loaded tab slides backwards. While one end of the electrical bridge slides along the long electrical bar and maintains electrical contact the other end of the electrical bridge slides on to the short electrical bar and closes at this stage momentarily the triggering circuit. The triggering circuit re-opens at the end of the shaving stroke when the pressure from the blades unit is relieved and when simultaneously the electrical bridge slides off the short electrical bar.

The momentary actuation of the trigger signal activates an electronic relay. The electronic relay closes the main circuit that actuates the required vibrating, oscillating, heating and/or water-sprinkling function. A timing cycle provides a selected time delay that starts either at the same time as the trigger signal or a little bit thereafter. The relay releases and opens the main circuit each time at the end of the timing cycle.

The time delay selected is a few seconds, longer than the normal time between two successive shaving strokes thus the timing cycle is reset again and again with each new shaving stroke. The main circuit is thus maintained closed until the delay after the last final shaving stroke.

It should be stressed that said momentary switch is given as an example only and many variations thereof are possible. Naturally also other triggering and automatic actuating means may be used.

The electronic relay and the time delay may form, for example, a part of a small integrated circuit.

Three position off, auto and on electrical switch 18 or two position off and auto electrical switch 19 may be incorporated in the shaving apparatus end. These switches are shown, for example, in FIG. 1.

These positions have the following meanings:

1. Auto—normal position, system starts and shuts off automatically;

2. Off—The automatic function is disabled, recommended use is to eliminate inadvertent operation during transportation or travel for example. (Else battery removal might be recommended).

Note: An alternative shaving apparatus holder with a positive shaving apparatus locking may be designed to prevent inadvertent operation; and 3. On—Automatic function disabled; may be used if the automatic system fails.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
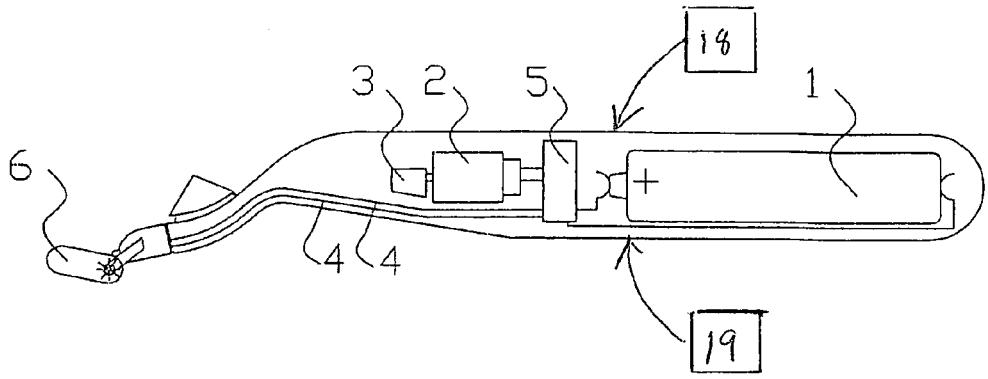
FIG. 1 shows a section through the shaving apparatus in which there are indicated those parts shown in the M3 Power Gillette apparatus and the novel parts, i.e. parts 4 and 5.

FIG. 1 shows a section through the shaving apparatus according to the present invention. The shaving apparatus comprises battery 1 connected to electric motor 2 with a rotating eccentric mass 3. The trigger signal passes through trigger wires 4 and actuates an electronic relay being part of integrated circuit 5. The relay closes the main circuit that actuates the required vibrating, oscillating heating and/or water-sprinkling function. A timing cycle being also part of 5 provides a selected delay. The relay is released at the end of the timing signal.

Figure 2:
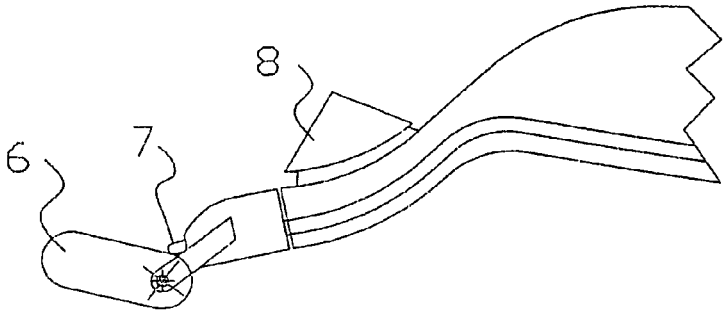
FIG. 2 shows an enlarged section of the shaving apparatus according to the present invention at the blades unit side.

FIG. 2 shows an enlarge detail of the shaving apparatus end including the pivoting razor blades unit 6, spring loaded tab 7 that maintains the blades pressure against the skin and blades unit release push button 8.

Figure 3:
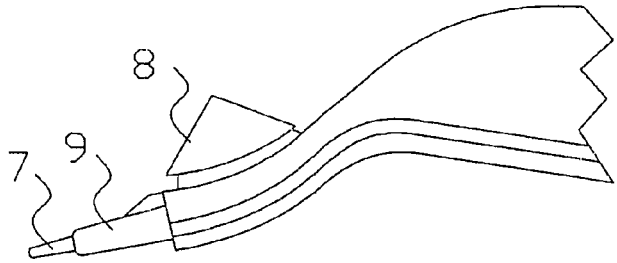
FIG. 3 shows the same section as FIG. 2 with the blade unit removed.

FIG. 3 shows the blades unit holder 9 and the spring loaded tab 7 in the same detail as in FIG. 2 with blades unit 6 omitted for clarity.

Figure 4:
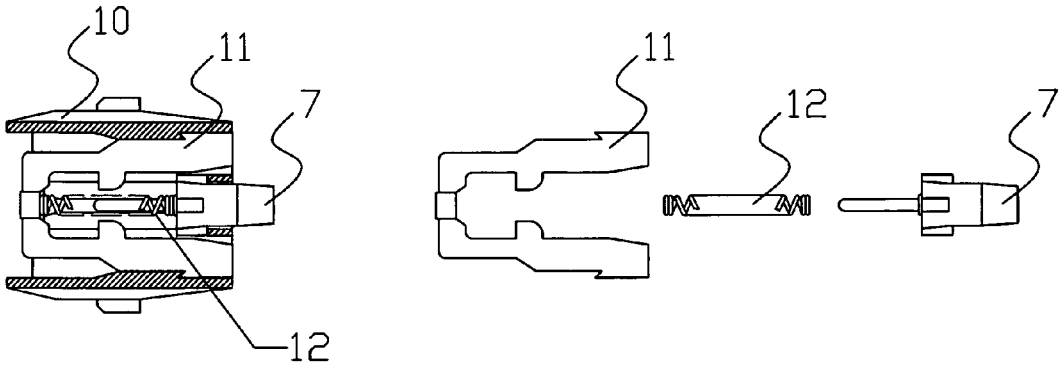
FIG. 4 shows an enlarged section through a standard blades unit holder and its individual components.

FIG. 4 shows an enlarged section of a standard blades unit holder assembly including blades unit holder body 10 spring loaded tab 7, spring 12 and blades unit release push plate 11 that is engaged with the blades unit release push button 8.

Figure 5:
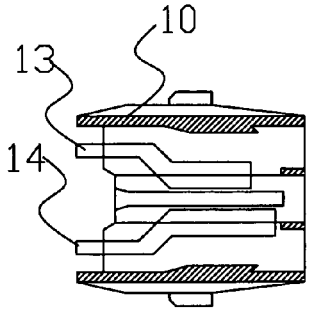
FIG. 5 shows a modified blades unit holder body being a momentary switch.

FIG. 5 shows a section of a modified blades unit holder body 10 with momentary switch contacts comprising short 13 and long 14 electrical contact bars embedded in the blades unit holder body 10. Bars ends of blades 13 and 14 are electrically connected to triggering wires 4.

Figure 6:
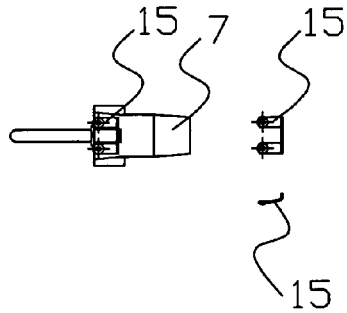
FIG. 6 shows a modified spring loaded tab assembly with an electrical bridge and the electrical bridge alone (two views)

FIG. 6 shows modified spring loaded tab 7 with an embedded electrical flexible (spring) bridge. Two views of the bridge are also shown separately. When no pressure is applied to razor blades unit 6 spring loaded tab 7 is extended outwards, one end of electrical bridge 15 rests against long electrical contact bar 14 while the other end of bridge 15 is not in touch with short electrical contact bar 13 and thus opens the circuit. With the first shaving stroke and with every following shaving stroke spring loaded tab 14 slides backwards and bridge 15 closes momentarily the triggering circuit.

Figure 7:
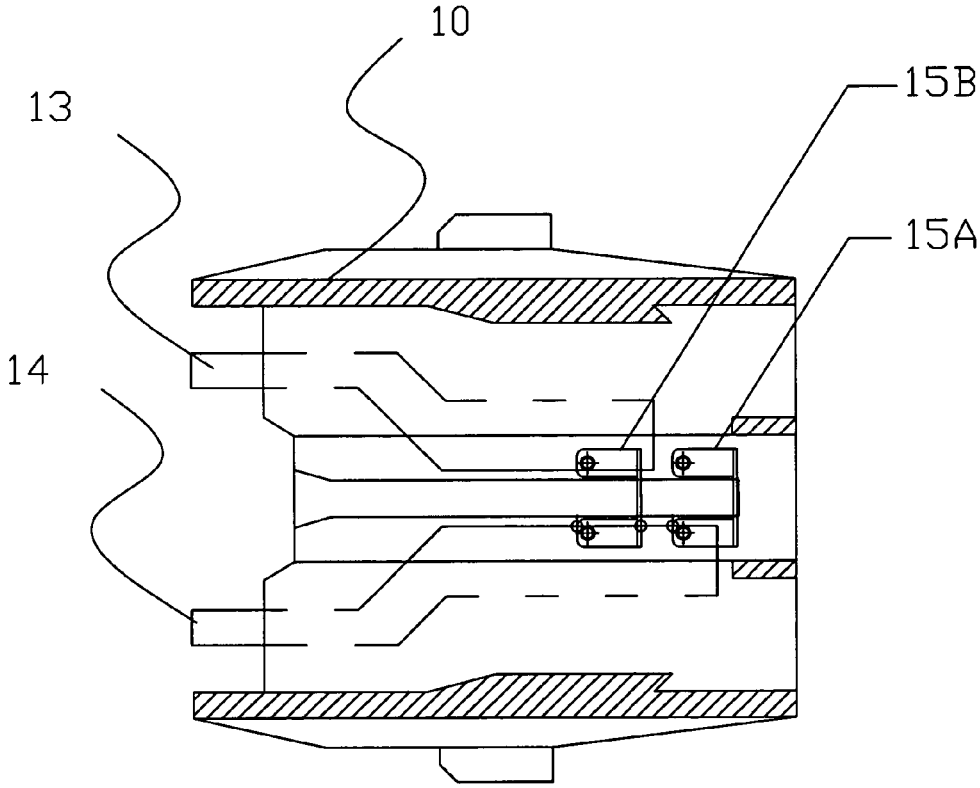
FIG. 7 shows an enlarged scale of FIG. 5.

FIG. 7 shows the enlarged section of FIG. 5 with the electrical bridge at open circuit position 15A and at closed circuit position 15B.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claim

The invention claimed is:

1. An automatic shaving apparatus system, comprising:

a blades unit;

a blades unit holder body; and automatic start and shutoff means for improved shaving conduct, and wherein the automatic start and shutoff means includes an element having an electrical contact switch having two contacts located only in the blades unit holder body and adapted to bring the two contacts together to make and break electrical contact in response to pivoting motion between the blades unit holder body and the blades unit for actuating the automatic start and shutoff means of the automatic shaving apparatus system.

2. The automatic shaving apparatus system according to claim 1, further comprising electrical means which actuate the operation of a vibrating, oscillating, heating and/or water-sprinkling system.

3. The automatic shaving apparatus system according to claim 2, wherein the electrical means are a battery.

4. The automatic shaving apparatus system according to claim 3, wherein the automatic means are triggering means.

5. The automatic shaving apparatus system according to claim 4, wherein the triggering means are a momentary switch.

6. The automatic shaving apparatus system according to claim 5, wherein said switch comprises short and long electrical contact bars embedded in the blades unit holder body.

7. The automatic shaving apparatus system according to claim 6, wherein the bars are connected electrically to the triggering means.

8. The automatic shaving apparatus system according to claim 5, wherein the switch is embedded in the blades unit holder body.

9. The automatic shaving apparatus according to claim 1, further comprising an electrical switch with two or three positions incorporated in a shaving apparatus handle which have the following meanings:

1. Auto—normal position shuts off automatically;
2. Off—the automatic function is disabled; and
3. On—Automatic function disabled may be used if the automatic system fails.

10. An automatic shaving apparatus system, comprising:

an automatic start and shutoff device, said automatic start and shutoff device providing improved shaving conduct, and wherein the automatic start and shutoff device includes an element responsive to pivoting movement of a blades unit with respect to a blades unit holder body for actuating the automatic start and shutoff device of the automatic shaving apparatus system, and wherein the automatic start and shutoff device element has an electrical contact switch having two contacts located only in the blades unit holder body and is adapted to bring the two contacts together to make and break electrical contact.

11. The automatic shaving apparatus system according to claim 10, further comprising an electrical device that actuates the operation of a vibrating, oscillating, heating and/or water-sprinkling system.

12. The automatic shaving apparatus system according to claim 11, wherein the electrical device is a battery.

13. The automatic shaving apparatus system according to claim 12, wherein the automatic device is a triggering device.

14. The automatic shaving apparatus system according to claim 13, wherein the triggering device is a momentary switch.

15. The automatic shaving apparatus system according to claim 14, wherein said switch comprises short and long electrical contact bars embedded in the blades unit holder body.

16. The automatic shaving apparatus system according to claim 15, wherein the bars are connected electrically to the triggering device.

17. The automatic shaving apparatus system according to claim 14, wherein the switch is embedded in the blades unit holder body.

18. The automatic shaving apparatus according to claim 10, further comprising, in a shaving apparatus handle, an electrical switch with two or three positions which have the following meanings:

1. Auto—normal position shuts off automatically;
2. Off—the automatic function is disabled; and
3. On—Automatic function disabled may be used if the automatic system fails.

* * * * *